US010603568B2

(12) United States Patent
Palanethra et al.

(10) Patent No.: US 10,603,568 B2
(45) Date of Patent: Mar. 31, 2020

(54) PROJECTILE LAUNCHING MACHINE

(71) Applicant: Freebowler, LLC, East Stroudsburg, PA (US)

(72) Inventors: Pratheek Palanethra, Herndon, VA (US); Justin Jacobs, Bethlehem, PA (US); Pranav Modali, York, PA (US)

(73) Assignee: freebowler, LLC, Whitehall, PA (US)

( * ) Notice: Subject to any disclaimer, the term of this patent is extended or adjusted under 35 U.S.C. 154(b) by 0 days.

(21) Appl. No.: 16/318,718

(22) PCT Filed: Jul. 18, 2017

(86) PCT No.: PCT/US2017/042475
§ 371 (c)(1),
(2) Date: Jan. 18, 2019

(87) PCT Pub. No.: WO2018/017507
PCT Pub. Date: Jan. 25, 2018

(65) Prior Publication Data

US 2019/0290989 A1 Sep. 26, 2019

Related U.S. Application Data

(60) Provisional application No. 62/441,650, filed on Jan. 3, 2017, provisional application No. 62/363,778, filed
(Continued)

(51) Int. Cl.
*A63B 69/40* (2006.01)
*F41B 3/03* (2006.01)
(Continued)

(52) U.S. Cl.
CPC ..... *A63B 69/408* (2013.01); *F41B 3/03* (2013.01); *A63B 2102/18* (2015.10); *A63B 2102/20* (2015.10)

(58) Field of Classification Search
CPC ..... A63B 69/407; A63B 69/408; F41B 3/03
(Continued)

(56) References Cited

U.S. PATENT DOCUMENTS 1,162,910 A * 12/1915 Goude ..... A63B 69/408 124/7
1,384,046 A * 7/1921 Carrino ..... A63B 69/408 124/7
(Continued)

FOREIGN PATENT DOCUMENTS

AU 2011201217 10/2011
GB 1529396 10/1978
(Continued)

OTHER PUBLICATIONS

PCT/US2017/042475 International Preliminary Report on Patentability, dated Jan. 22, 2019.
(Continued)

*Primary Examiner* — Alexander R Niconovich
(74) *Attorney, Agent, or Firm* — Joseph E. Maenner; Maenner & Associates, LLC

(57) ABSTRACT

A projectile launching machine includes a base having a front end and a rear end, a front leg assembly coupled to the front end and an upper end, distal from the lower end. A throwing arm is coupled to the upper end of the front leg assembly at a pivot. The throwing arm has a biased end extending from the pivot and a ball end distal from the biased end. The throwing arm is movable between a locked position and a throw position. A biasing member is connected to the biased end and a second biasing member end is movably coupled to the front leg assembly. An arm release mechanism has a first end connected to the front leg assem-
(Continued)

bly and a second end movable between a locking position wherein the throwing arm is in the locked position and a release position.

17 Claims, 15 Drawing Sheets

Related U.S. Application Data on Jul. 18, 2016, provisional application No. 62/383,615, filed on Sep. 6, 2016.

(51) Int. Cl.
*A63B 102/18* (2015.01)
*A63B 102/20* (2015.01)

(58) Field of Classification Search
USPC ..... 124/6, 7, 8
See application file for complete search history.

(56) References Cited

U.S. PATENT DOCUMENTS 1,912,360 A * 6/1933 Blanchard ..... A63B 69/408 124/7
2,080,958 A * 5/1937 Beasley ..... A63B 69/408 124/7
3,254,639 A * 6/1966 Laird ..... A63B 69/408 124/7
3,406,674 A * 10/1968 Zone ..... A63B 69/408 124/7
3,470,859 A * 10/1969 Ponza ..... A63B 69/408 124/7
3,552,371 A * 1/1971 Kahelin ..... A63B 69/408 124/7
3,648,678 A * 3/1972 Luebkeman ..... A63B 69/408 124/7
3,722,494 A * 3/1973 Slevin ..... A63B 69/408 124/7
4,033,318 A * 7/1977 O'Grady ..... A63B 69/408 124/7
4,082,076 A * 4/1978 Perry ..... A63B 69/408 124/34
4,721,091 A * 1/1988 Ridley ..... A63B 69/408 124/16
4,844,045 A * 7/1989 Powell ..... A63B 69/408 124/7
4,860,717 A * 8/1989 Powell ..... A63B 69/408 124/7
4,995,371 A * 2/1991 Kuizinas ..... A63B 47/002 124/36
5,439,212 A * 8/1995 Hart ..... A63B 69/408 124/7
5,660,386 A * 8/1997 Krieger ..... A63B 69/407 124/7
6,129,076 A * 10/2000 Powell ..... A63B 69/408 124/36
6,877,499 B1 * 4/2005 Otto ..... A63B 69/408 124/16
7,066,846 B2 * 6/2006 Horkan ..... A63B 69/002 124/7
7,415,976 B1 * 8/2008 Powell ..... F41B 3/04 124/16
7,748,367 B2 * 7/2010 Kosjer ..... A63B 69/0002 124/16
8,286,619 B2 * 10/2012 Mihaljevic ..... A63B 69/408 124/16
9,067,118 B2 * 6/2015 Colding-Kristensen ..... A63B 69/408
9,199,154 B2 * 12/2015 Kroll ..... A63B 69/408
9,981,174 B1 * 5/2018 Decilveo ..... A63B 69/408
10,088,282 B2 * 10/2018 Laporte ..... F41J 9/22
2013/0340737 A1 * 12/2013 Ferguson ..... A63B 69/40 124/80
2016/0250536 A1 * 9/2016 Hart ..... A63B 69/40 124/7

FOREIGN PATENT DOCUMENTS

JP 2007229451 9/2007
JP 2008259723 10/2008

OTHER PUBLICATIONS

International Search REport and Written Opinion for PCT/US2017/042475, dated Oct. 30, 2017. 9 pages.
PCT/US2017/042475—International Preliminary Report on Patentability, dated Jan. 22, 2019. 5 pages.

* cited by examiner

PROJECTILE LAUNCHING MACHINE

CROSS-REFERENCE TO RELATED APPLICATIONS

The present application claims priority from U.S. Provisional Patent Application Ser. No. 62/363,778, filed on Jul. 18, 2016, U.S. Provisional Patent Application Ser. No. 62/383,615, filed on Sep. 6, 2016, and U.S. Provisional Patent Application Ser. No. 62/441,650, filed on Jan. 3, 2017, all of which are incorporated herein by reference in their entireties.

BACKGROUND OF THE INVENTION

Pitching machines are used to help baseball batters practice to improve their swing. Baseball, however, is not the only sport where a ball is pitched (or bowled) toward a batter. Other games, such as cricket, require a bowler to bowl a ball toward a batsman, who tries to hit the ball. A cricket bowl, however, differs from a baseball pitch in that cricket requires the bowler to bounce the ball in front of the batsman, resulting in a significantly different motion on the part of the bowler as compared to a baseball pitcher.

It would be beneficial to provide a cricket ball bowling machine that emulates the motions of a cricket bowler to generate a more realistically bowled ball.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a projectile launching machine having a base having a front end and a rear end, a front leg assembly extending having a lower end coupled to the front end of the base and an upper end, distal from the lower end and a throwing arm pivotally coupled to the upper end of the front leg assembly at a pivot, the throwing arm having a biased end extending from the pivot and a ball end distal from the biased end, the throwing arm movable between a locked position and a throw position. A biasing member having a first biasing member end is connected to the biased end and a second biasing member end movably coupled to the front leg assembly. An arm release mechanism has a first end connected to the front leg assembly between the lower end and the upper end, and a second end movable between a locking position wherein the throwing arm is in the locked position and a release position wherein the throwing arm is biased by the biasing member to the throw position.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
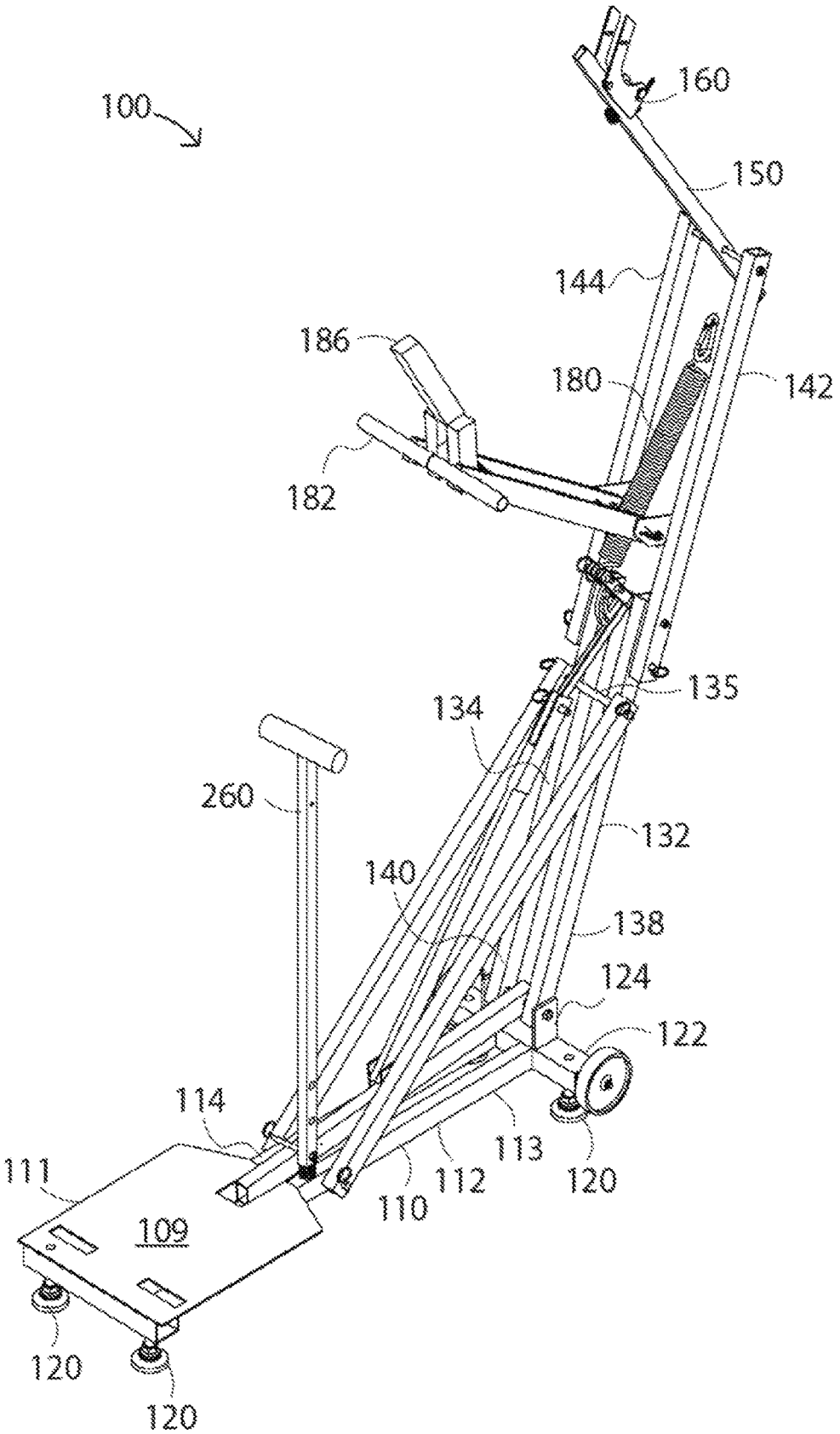
FIG. 1 is a perspective view of a projectile launching machine according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As shown in the Figures, the present invention is a device for launching projectiles, such as balls. While the inventive device can be used for various different sports or other uses, for the sake of simplicity, the device herein will be described as a bowling machine 100 ("machine 100") for bowling cricket balls. Machine 100 can be adjusted to vary the speed at which cricket balls are bowled, the angle of release of the ball from machine 100, and spin on the ball as the ball is bowled. Additionally, machine 100 can be used to launch balls high into the air to simulate "pop-ups" or fly balls for fielding practice as well.

In an exemplary embodiment, machine 100 is a portable device that is collapsible for transport and is easily assembled for bowling cricket balls. To facilitate the collapsibility of machine 100, several of the below-described components are removably connected to each other, such as with cotter pins or other removable connecting devices. While exemplary removable components are shown, those skilled in the art will recognize that machine 100 can be configured in other configurations that also allow for the collapsibility of machine 100. Alternatively, machine 100 can be constructed such that machine is not collapsible, such as for a permanent installation of machine 100.

Figure 2:
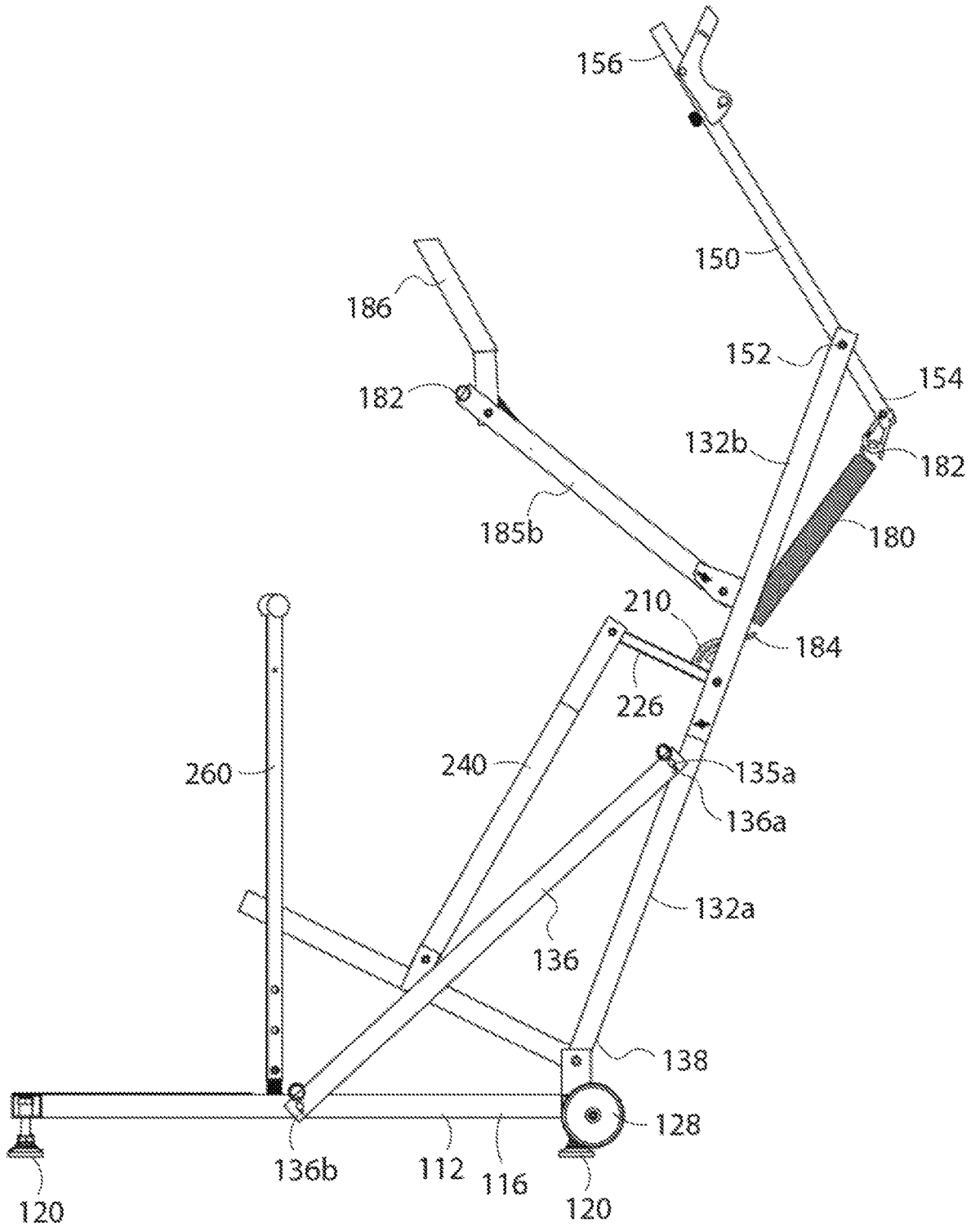
FIG. 2 is right side elevational view of the projectile launching machine of FIG. 1.
Figure 3:
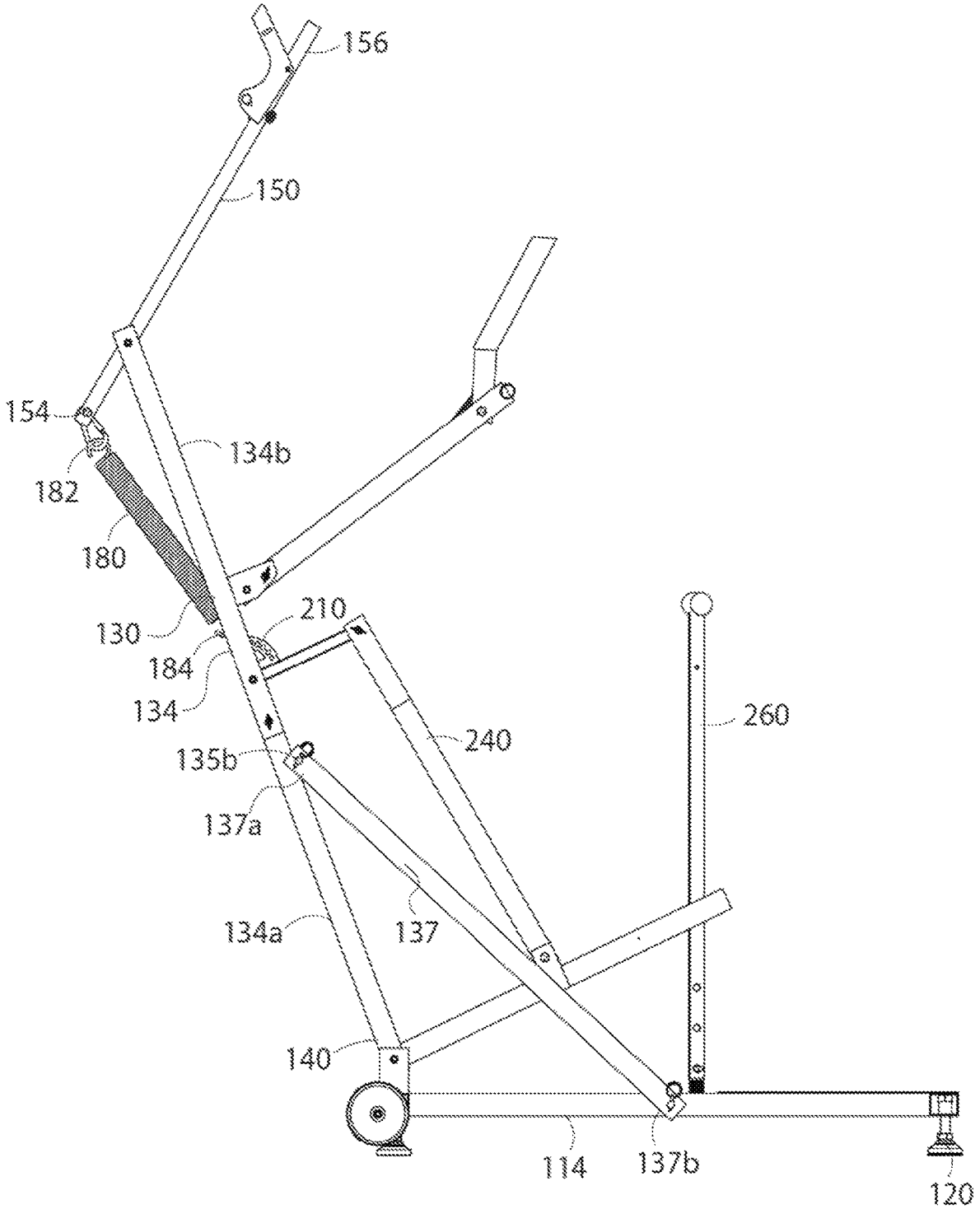
FIG. 3 is a left side elevational view of the projectile launching machine of FIG. 1.

FIGS. 1-13 show a first embodiment of a projectile launching machine 100 ("machine 100"). Machine 100 includes a base 110 having a rear end 111 comprising a foot pad 109. Referring to FIGS. 1-3, a front leg assembly 113, constructed from a pair of parallel elongate frame legs 112, 114 extend underneath and forward of foot pad 111. Legs 112, 114 are spaced apart from each other by a predetermined distance. Additionally, legs 112, 114 each includes a leveling pad 120 at either end to level machine 100 for operation.

Figure 4:
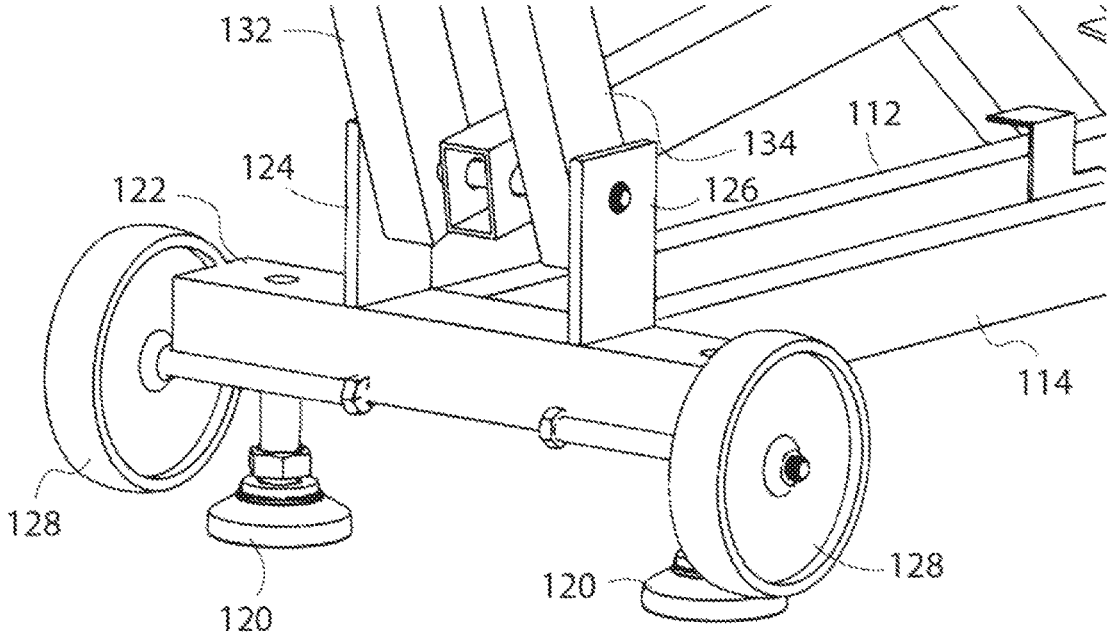
FIG. 4 is a perspective view of a front end of the frame of the projectile launching machine of FIG. 1.

The forward end of each frame leg 112, 114 is connected to a cross brace 122. A pair of vertical support brackets 124, 126 are fixedly connected to and extend upwardly from cross brace 122. Additionally, wheels 128, shown in FIG. 4 are mounted on cross brace 122 to allow machine 100 to be rolled without having to lift machine 100. When machine 100 is in an operating position as shown in FIGS. 2 and 3, wheels 128 extend forward of frame 110 and are off the surface on which machine 100 is placed.

A front leg assembly 130 includes a pair of front legs 132, 134. Legs 132, 134 can each be of a unitary construction. Alternatively, leg 132 can be constructed from a lower leg portion 132*a* and an upper leg portion 132*b* that is releasably connected to lower leg portion 132*a*. Similarly, leg 134 can be constructed from a lower leg portion 134*a* and an upper leg portion 134*b* that is releasably connected to lower leg portion 134*a*. A lower end 138, 140, respectively, of each of legs 132, 134 is coupled to front end 116 of base 110. In an exemplary embodiment, legs 132, 134 are each connected to a respective support bracket 124, 126. While leg portions 132*a*, 132*b* and 134*a*, 134*b* are shown as connected to each other side-by-side, those skilled in the art will recognize that leg portions 132*a*, 132*b* and 134*a*, 134*b* can be telescopically connected to each other.

As shown in FIG. 1, a rod 135 connects legs 132, 134 to each other about half way up the length of legs 132, 134. Rod 135 extends generally parallel to a floor surface on which machine 100 is mounted. Rod 135 also has opposing ends 135*a*, 135*b* that each extend outwardly of front leg assembly 130.

As shown in FIG. 2, a first brace 136 extends upwardly from a mid-location on frame leg 112 to rod 135. A first end 136*a* of first brace 136 is removably attachable to end 135*a*. A second end 136*b* of brace 136 is removably attachable to frame leg 112. Similarly, as shown in FIG. 3, a second brace 137 extends upwardly from a mid-location on frame leg 114 to rod 135. A first end 137*a* of second brace 137 is removably attachable to end 135*b*. A second end 137*b* of brace 137 is removably attachable to frame leg 114. Braces 136, 137 are used to support frame 130 and are removable to support the collapsibility of machine 100.

Figure 5:
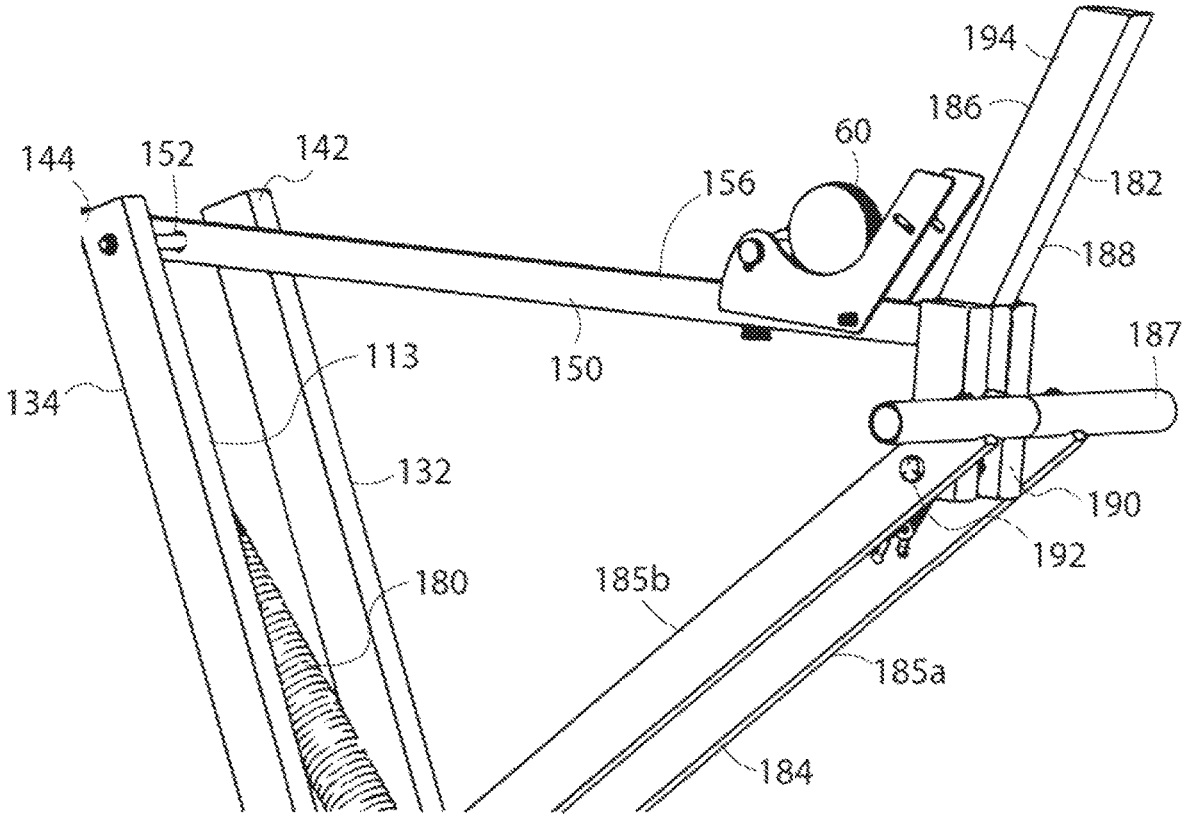
FIG. 5 is a rear perspective view of a throwing arm used on the projectile launching machine of FIG. 1.
Figure 6:
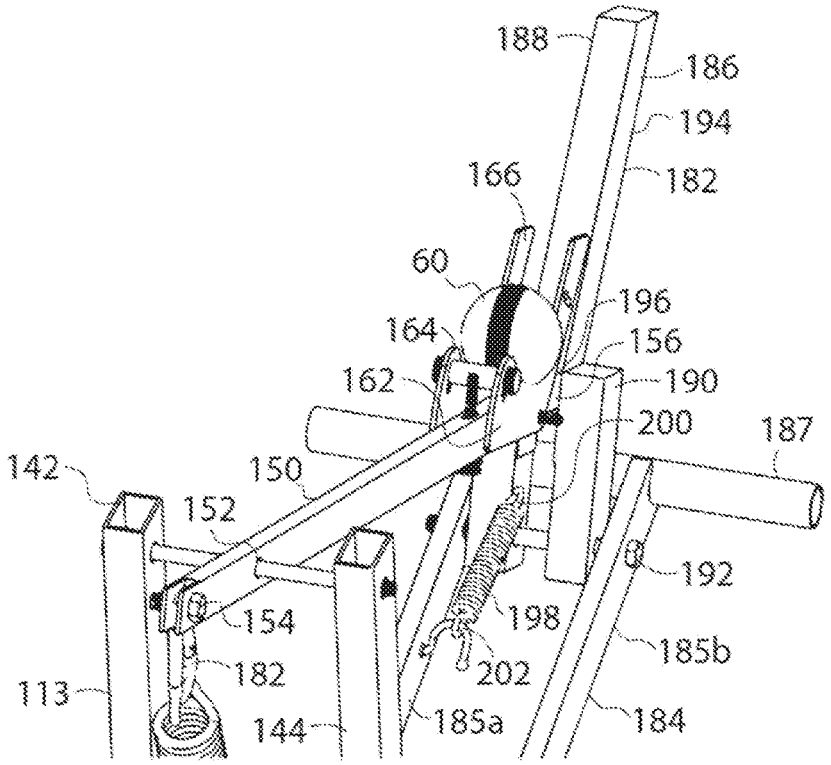
FIG. 6 is a front perspective view of the throwing arm of FIG. 5.
Figure 7:
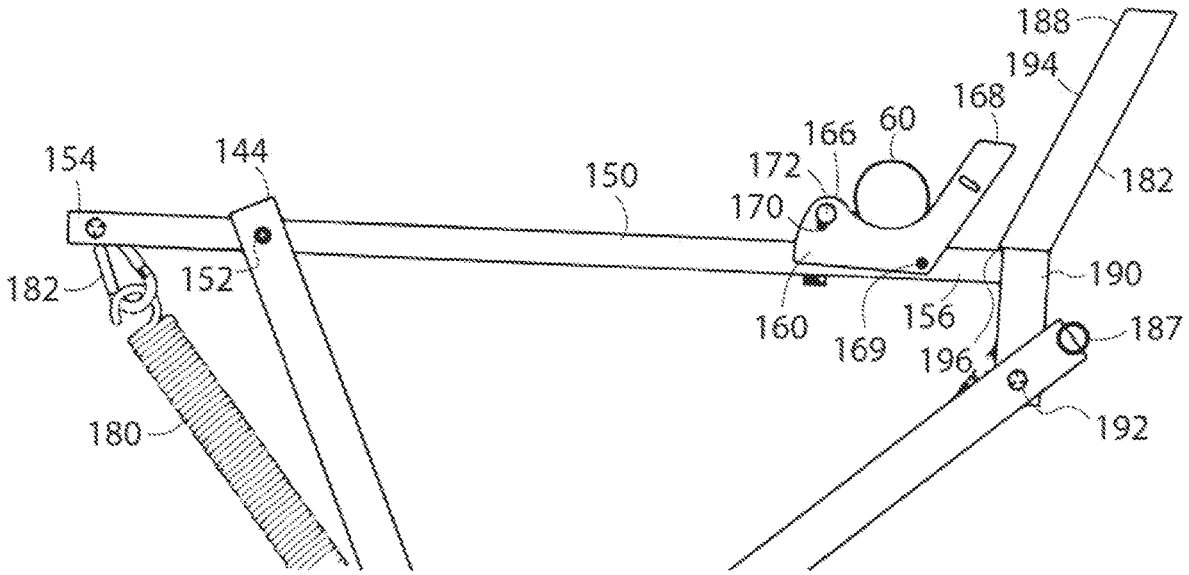
FIG. 7 is a side elevational view of the throwing arm of FIG. 5.
Figure 8:
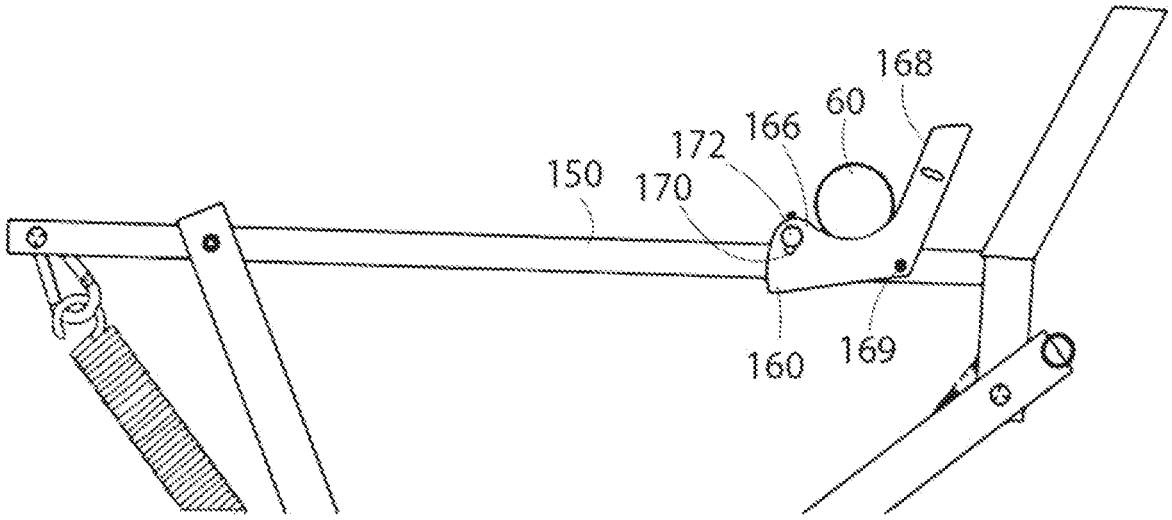
FIG. 8 is a side elevational view of the throwing arm of FIG. 5, with the entire cradle adjusted relative to the position show in FIG. 5.
Figure 9:
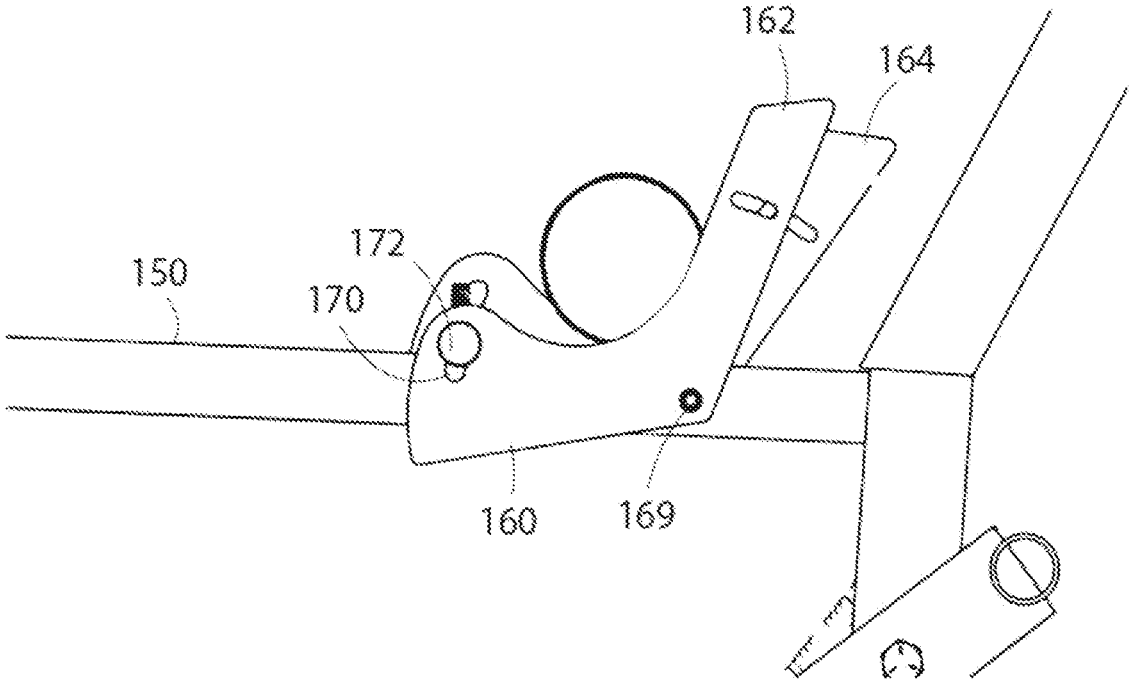
FIG. 9 is a side elevational view of the throwing arm of FIG. 5, with one finger of the cradle adjusted relative to the position shown in FIG. 5.
Figure 9A:
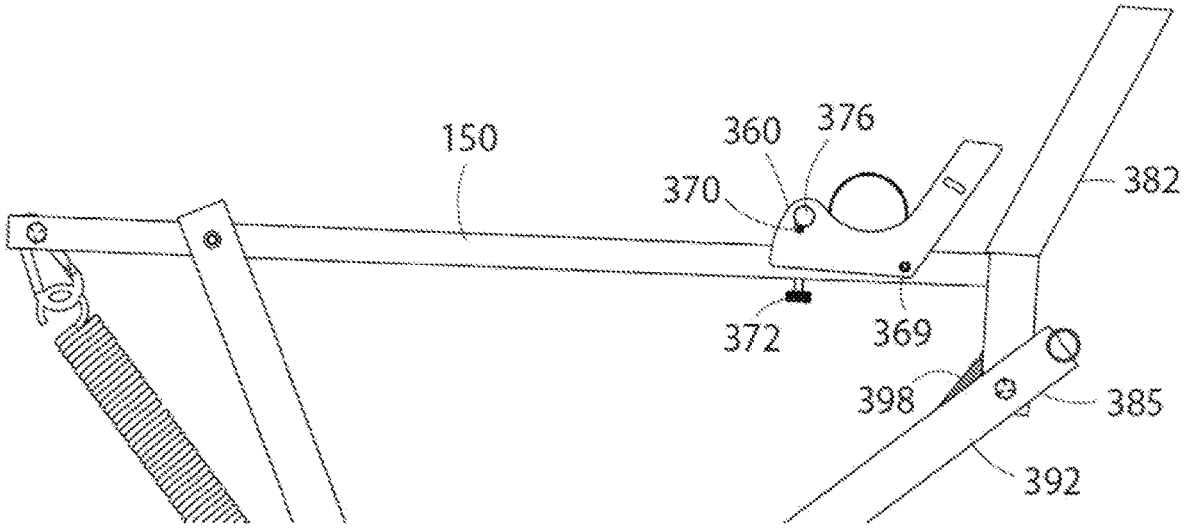
FIG. 9A is a side elevational view of an alternative embodiment of a cradle mounted on the throwing arm of the machine and throwing arm release mechanism shown in FIG. 1.
Figure 9B:
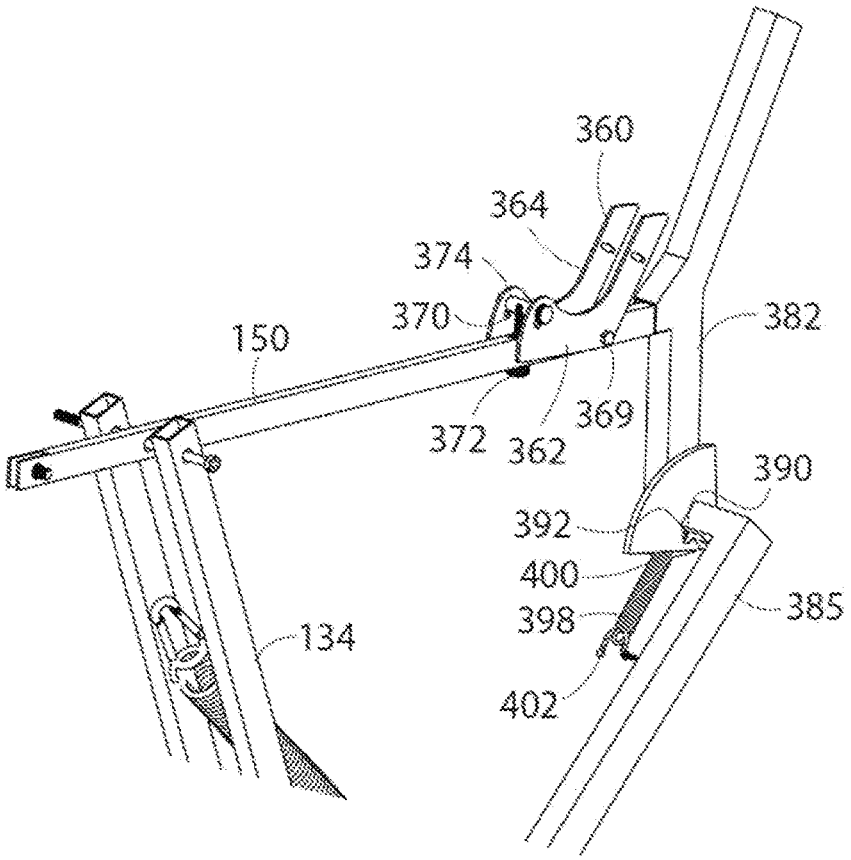
FIG. 9B is a front perspective view of the cradle and throwing arm release mechanism shown in FIG. 9A.
Figure 9C:
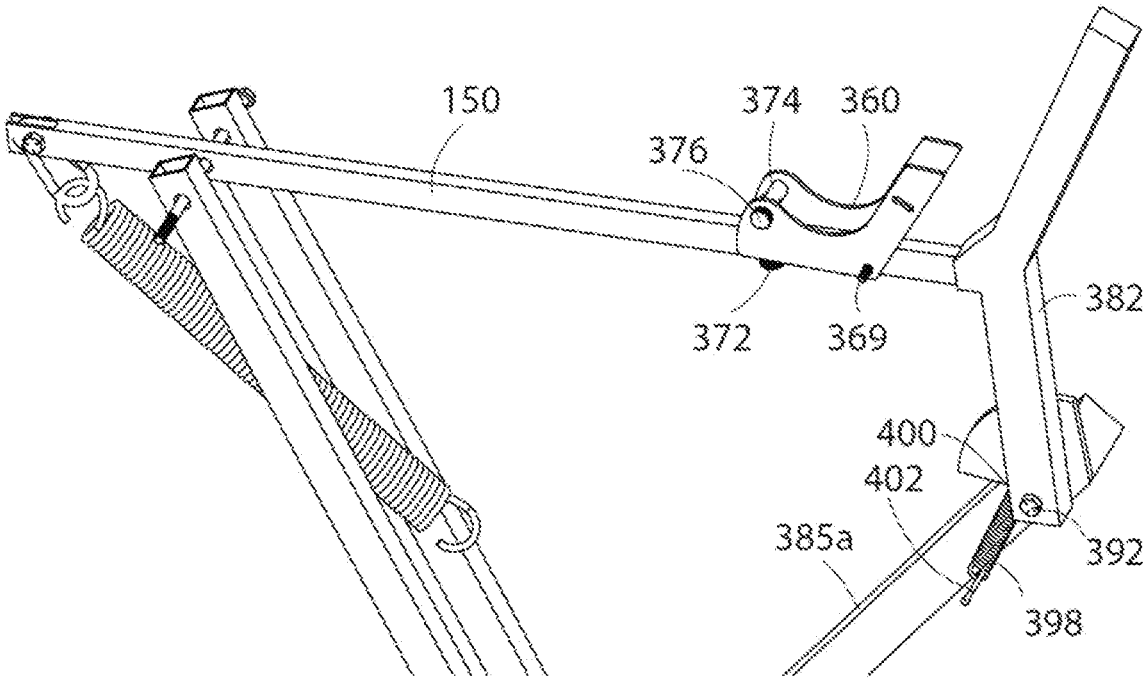
FIG. 9C is a rear perspective view of the cradle and throwing arm release mechanism shown in FIG. 9A.
Figure 9D:
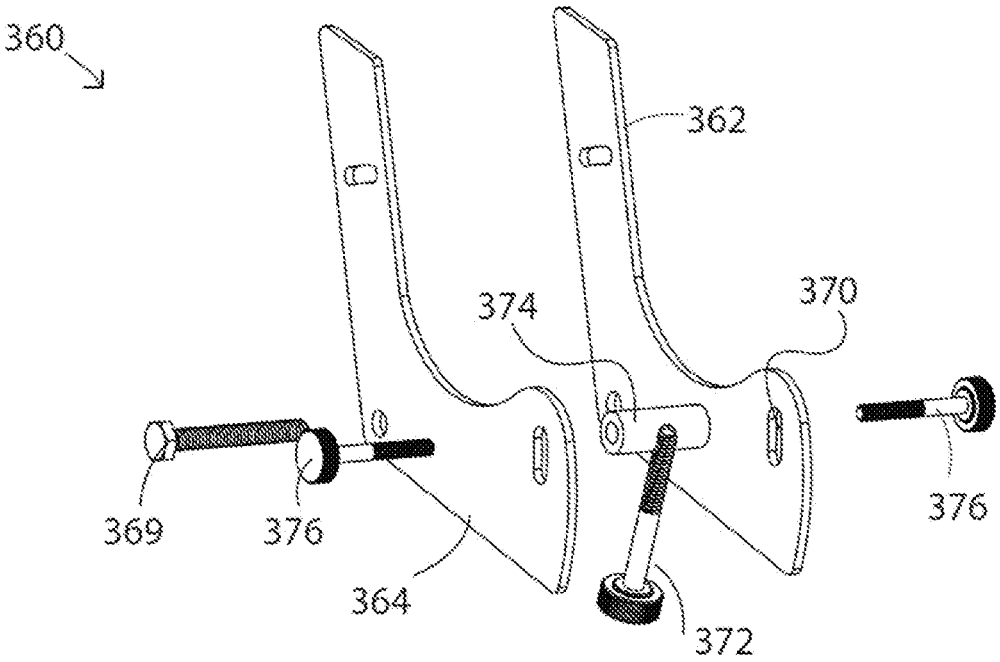
FIG. 9D is an exploded view of the cradle shown in FIGS. 9A-9C.
Figure 10:
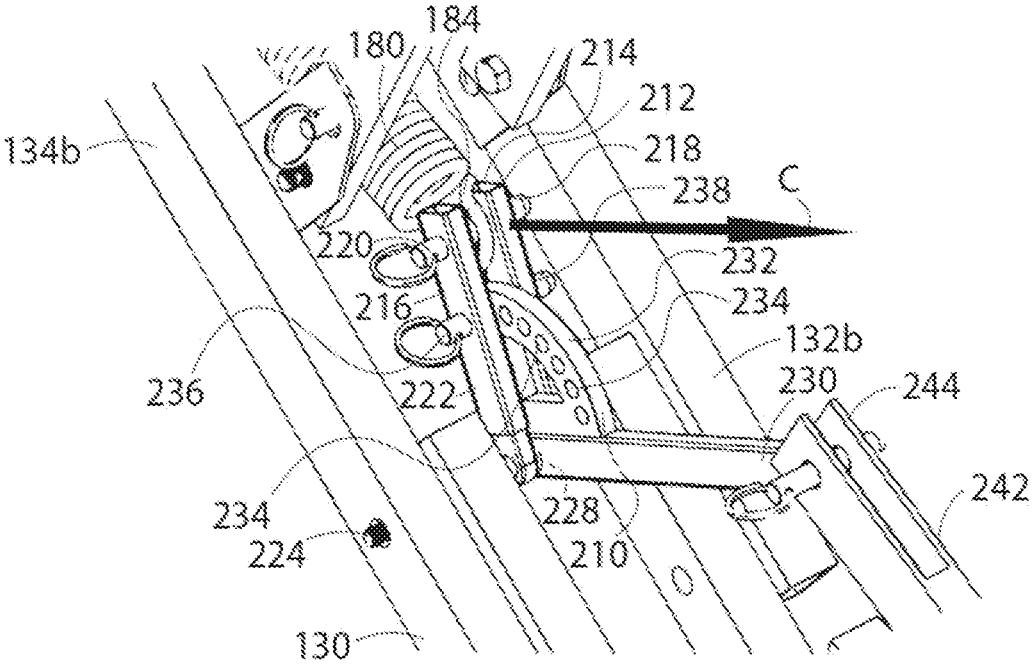
FIG. 10 is a perspective view of an upper end of a biasing member adjustment mechanism used with the machine of FIG. 1.

Referring to FIGS. 5-7, an upper end 142, 144 of each of legs 132, 134, distal from lower end 138, 140, respectively, supports a throwing arm 150. Throwing arm 150 is pivotally coupled to upper ends 142, 144 of front leg assembly 113 at a pivot 152. Throwing arm 150 has a biased end 154 that extends in a first direction from pivot 152 and a ball end 156 distal from biased end 154. Throwing arm 150 is movable between a locked position that allows a projectile, such as a ball 60, to be loaded onto throwing arm 150 and a throw position, in which throwing arm 150, and the totality of machine 100, launches ball 60.

Referring to FIGS. 6-9, ball end 156 includes a cradle 160 that is adapted to receive and retain a projectile, such as a ball 60. Cradle 160 is adjustably mounted on throwing arm 150 such that the spin of ball 60 can be modified by adjusting cradle 160. Cradle 160 comprises a first finger 162 mounted on a first side of throwing arm 150 and a second finger 164 mounted on an opposing side of throwing arm 150 (see FIG. 6). Each of first finger 162 and second finger 164 are independently adjustable relative to throwing arm 150.

Each finger 162, 164 includes a generally curved face 166 on which ball 60 is placed, as shown in FIG. 7. Each finger 162, 164 also includes a generally elongate linear face 168 that extends from its respective curved face 166. Elongate linear face 168 provides a surface along which ball 60 rotates as ball is launched, thereby imparting a rotation to ball 60 as ball is launched from machine 100.

Each finger 162, 164 is pivotally mounted to throwing arm 150 at a pivot 169. An adjusting slot 170 is located distal from pivot 169. A locking device, such as a wing nut 172, extends through adjusting slot 170 and into throwing arm 150. Wing nut 172 allows its respective finger 162, 164 to pivot about pivot 169 to adjust the location of curved face 166 and linear face 168 relative to throwing arm 150 and secure the respective finger 162, 164 in a desired position.

Because fingers 162, 164 are independently adjustable, fingers 162, 164 can be pivoted different amounts, which can impart a spin on ball 60 as ball 60 is launched from machine 100. For example, moving fingers 162, 164 between the position shown in FIG. 7 and the position shown in FIG. 8 alters the angle at which ball 60 is launched from machine 100. Also, by way of example, moving fingers 162, 164 between the position shown in FIG. 7 and the position shown in FIG. 9 alters the spin imparted to ball 60 as ball 60 is launched from machine 100.

An alternative embodiment of a cradle 360 is shown in FIGS. 9A-9D. Cradle 360 is similar to cradle 160, but each finger 362, 364 is pivotally mounted to throwing arm 150 at a pivot 369. An adjusting slot 370 is located distal from pivot 369, above throwing arm 150. An adjusting device, such as a screw 372, extends through throwing arm 150 and into a threaded receiver 374. Rotational adjustment of screw 372 advances receiver 374 along the length of screw 372, pivoting the entire cradle 360 about pivot 369.

Receiver 374 includes threaded ends 376 that releasably retain receiver 374 in slot 370. Threaded ends 376 each allow its respective finger 362, 364 to individually pivot about pivot 369 to adjust the location of curved face 166 and linear face 168 relative to throwing arm 150 and secure the respective finger 362, 364 in a desired position.

Referring to FIGS. 2 and 3, a biasing member 180 has a first biasing member end 182 connected to biased end 154 of throwing arm 150 and a second biasing member end 184 movably coupled to front leg assembly 130. In an exemplary embodiment, biasing member 180 can be a helical spring, although those skilled in the art will recognize that biasing member 180 can be other suitable biasing devices. Biasing member 180 provides the motive force to pivot throwing arm 150 to launch ball 60.

Referring back to FIG. 7, ball end 156 of throwing arm 150 extends sufficiently far from cradle 160 such that, regardless of the pivoted location of fingers 162, 164, ball end 156 can engage with a throwing arm release mechanism 182 that is selectively movable between a first position to prevent throwing arm from launching ball 60 and a second position in which throwing arm release mechanism 182 releases throwing arm 150 to launch ball 60.

As shown in FIGS. 5 and 6, arm release mechanism 182 includes a first end 184 connected to the front leg assembly 130 between lower ends 138, 140 and upper ends 142, 144 of legs 132, 134, respectively, and a second end 186 movable between a locking position wherein throwing arm 150 is in the locked position and a release position wherein throwing arm 150 is biased by biasing member 180 to the throw position.

First end 184 includes a first holding arm **185*a* connected to leg 132 and a second holding arm 185*b* connected to leg 134. A handle bar 187 located at ends of holding arms 185*a*, 185*b*, distal from legs 132, 134, provides a handle for a user to grasp to stabilize himself on machine 100**.

Second end 186 of arm release mechanism 182 comprises a pull handle 188 pivotally coupled to holding arms **185*a*, 185*b*. Pull handle 188 is biased from a throwing arm release position to a throwing arm locking position. Pull handle 188 includes a pivot end 190 that is pivotally connected to and between holding arms 185*a*, 185*b* via a pivot bar 192. Pull handle 188 also includes a grasping end 194, distal from pivot end 190 that the user grasps and pulls toward himself to release throwing arm 150 to launch ball 60. Grasping end 194 extends oblique to a vertical axis toward the user such that, when throwing arm 150 is moved to the locked position, ball end 156 engages and slides down grasping end 194, pivoting grasping end 194** away from the user.

Pull handle 188 includes a throwing arm engager 196 that engages ball end 156 when throwing arm 150 is in a locked position. A biasing member 198 includes a first end 200 connected to pivot end 190 above pivot bar 192 and a second end 202 connected to holding arm **185*b* below pivot bar 192 such that pull handle 188 is biased toward throwing arm engager 196, engaging ball end 156 of throwing arm 150 when throwing arm 150** is biased toward a locked position.

Referring back to FIGS. 9A-9C, an alternative embodiment of a release mechanism 382 is shown. Mechanism 382 includes a single holding arm 385 that is connected to and extends from leg 134. A single pivot end 390 pivots about a pivot bar 392. A biasing member 398 includes a first end 400 connected to a pivot end 390 above a pivot bar 392 and a second end 402 connected to holding arm **185*a* below pivot bar 392 such that a pull handle 388 is biased toward throwing arm engager 396, engaging ball end 156 of throwing arm 150 when throwing arm 150** is biased toward a locked position.

Referring now to FIGS. 10-13, machine 100 also includes a biasing member (or speed) adjustment mechanism 210 that is used to adjust the tension of biasing member 180. Adjustment mechanism 210 includes a load arm 212 having a free end 214 connected to second biasing member end 184. Free end 214 includes legs 216, 218 that are parallel to each other and spaced apart sufficiently for send biasing member end 184 to extend therebetween. A pin 220 extends through each of legs 216, 218. Second biasing member end 184 is connected to pin 220.

Load arm 212 also includes a pivot end 222 that is pivotally coupled to front leg assembly 130 via a pivot pin 224. Adjustment mechanism 210 also includes a tension arm 226 having a first tension arm end 228 pivotally coupled to pivot end 222 of load arm 212 at pivot pin 224 and a connecting arm end 230, distal from pivot pin 224. A speed adjuster 232 is connected to tension arm 226 and has a plurality of speed varying locations 234 releasably connectable to load arm 212. In an exemplary embodiment, speed varying locations 234 comprise a plurality of slots that are aligned to form an arc such that, as tension arm 226 is pivoted about pivot pin 224, different speed varying locations 234 align with and between co-linear slots 236, 238 in legs 216, 218 of free end 214 of load arm 212. A pin 240 is removably insertable through slots 236, 238 as well as through a selected speed varying location 234 to releasably secure speed adjuster 232 to load arm 212.

Figure 12:
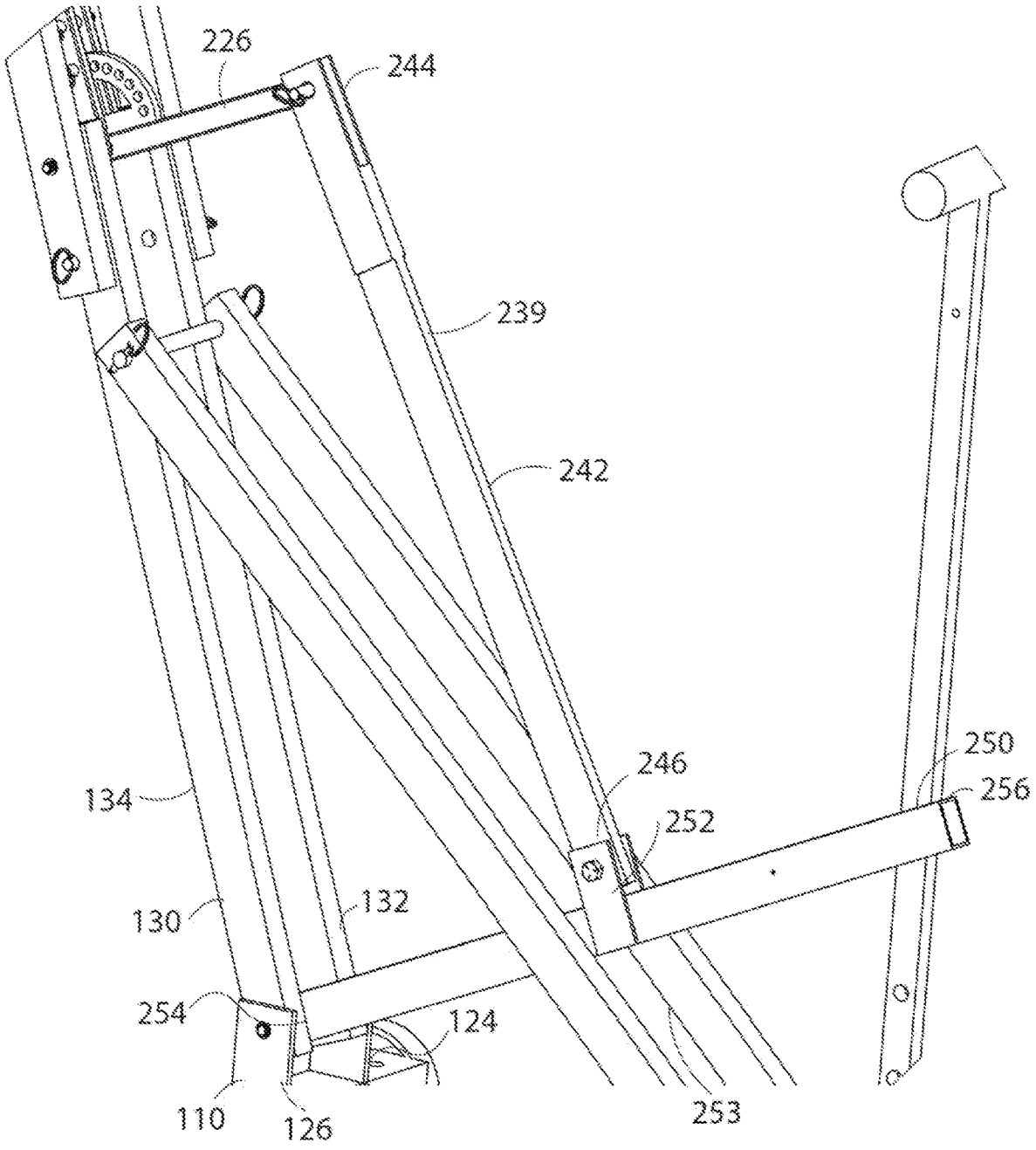
FIG. 12 is a perspective view of a foot pedal used with the biasing member adjustment mechanism shown in FIGS. 10-12.

Connecting arm end 230 of tension arm 226 is pivotally connected to a foot pedal assembly 239 that is operatively connected to 226 tension arm between a pedal release position and a tension adding position wherein tension is added to biasing member 180. Foot pedal assembly 239 further includes a connecting arm 242 having a first end 244 pivotally connected to connecting arm end 230 of tension arm 226 and a second end 246 that is pivotally coupled to a foot pedal 250 at a bracket 252 fixed to a central portion 253 of foot pedal 250. Foot pedal 250 includes a coupled end 254 pivotally coupled to one of frame 110 and front leg assembly 130. As shown in FIG. 12, coupled end 254 is pivotally coupled to brackets 124, 126. Foot pedal 250 further comprises a foot pad 256 distal from coupled end.

Foot pedal 250 is operable to add tension to biasing member 180. Depression of foot pad 256 pulls connecting arm 242 downwardly as shown by arrow "A" in FIG. 11, thereby pivoting tension arm 226 about pivot pin 224, which in turn pulls load arm 212 downward as shown by arrow "B" in FIG. 11 and elongating and loading biasing member 180 as shown by arrow "C" in FIG. 10. The amount of the load applied to biasing member 180 can be adjusted by varying the speed varying location 234 that engages pin 240. A speed varying location 234 closer to tension arm 226 that engages pin 240 results in more tension being applied to biasing member 180 than a speed varying location 234 farther from tension arm 226 that engages pin 240. Consequently, the higher the tension applied to biasing member 180, the quicker that biasing member 180 pivots throwing arm 150 when throwing arm 150 is released, resulting in a higher speed that is imparted to ball 60 when ball 60 is launched.

Figure 13:
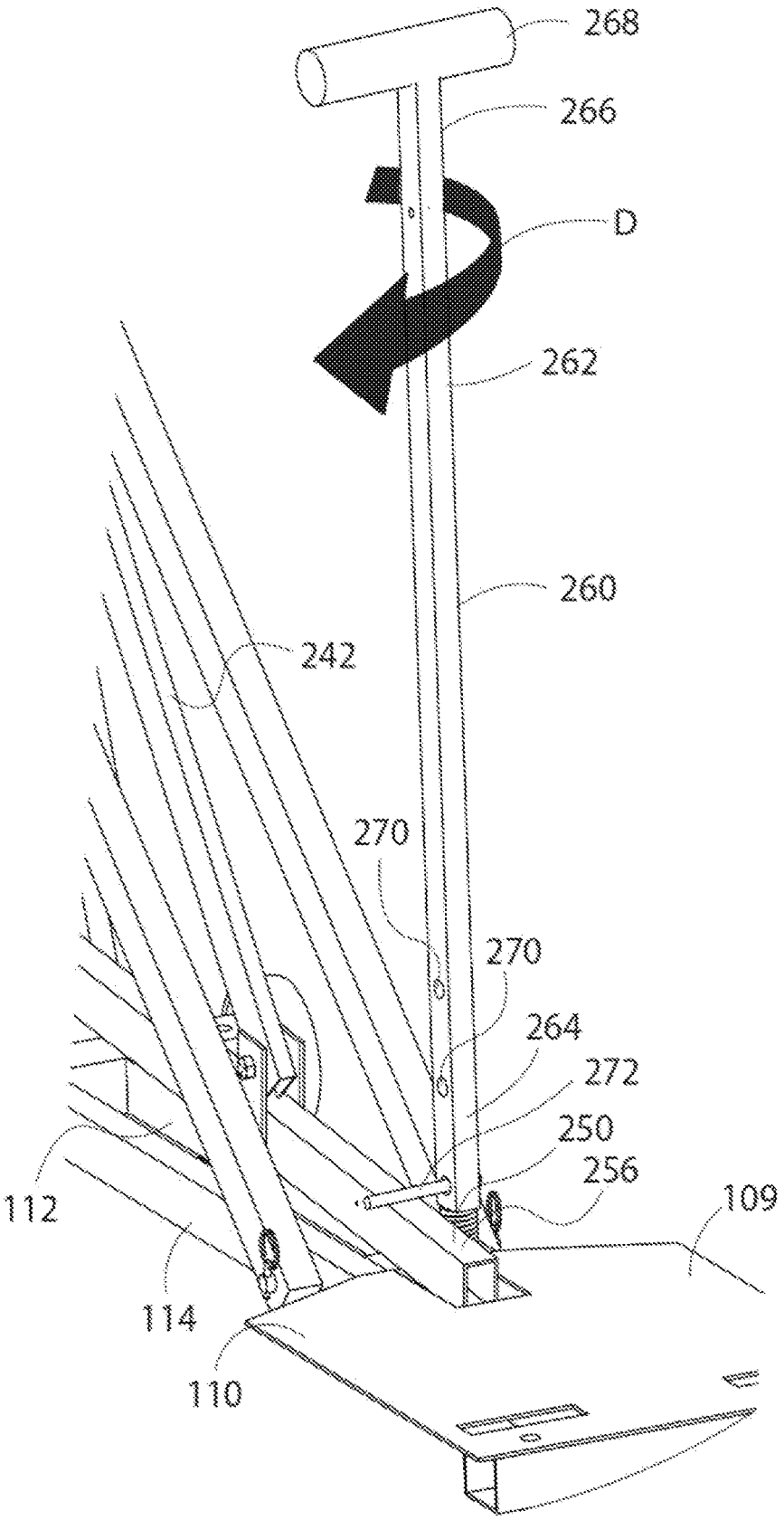
FIG. 13 is a perspective view of a foot pedal locking mechanism used with the foot pedal shown in FIG. 12.

Referring to FIG. 13, a locking mechanism 260 is adapted to releasably lock foot pedal 250 in the tension adding position. In a first exemplary embodiment locking mechanism 260 includes a handle 262 that is rotatable between a pedal locking position and a pedal release position. Handle 262 includes a lower end 264 that is rotatably mounted on frame leg 112 An upper end 266 of handle 262 includes a horizontal bar 268 that the user can grass to rotate handle 262. Handle 262 includes a plurality of slots 270 extending partially along the length of handle 262 proximate to lower end 264. A vertically adjustable locking arm 272 is removably insertable into each of the plurality of slots 270.

Handle 262 is rotatable between a first position in which locking arm 262 is out of the way of foot pedal 250 so that foot pedal 250 can be depressed to frame 110 and a second position that engages foot pedal 250 after foot pedal 250 has been depressed to frame 110 to prevent foot pedal 250 from upward movement beyond locking arm 272 after a user removes his foot from foot pedal 250. The slot 270 into which locking arm 272 is inserted determines how high foot pedal 250 moves upward after the foot is removed from foot pedal 250. The location of foot pedal 250 relative to handle 262 impacts the tension applied to biasing member 180 and, consequently, the speed of ball 60 when ball 60 is launched from machine 100.

In an exemplary embodiment, depending on multiple factors, including the strength of biasing member 180, the particular speed varying location 234 that engages that engages pin 224, and the location of locking arm 272 along handle 262, the speed of ball 60 being launched from machine 100 can vary between about 65 miles per hour (about 105 kilometers per hour) and about 95 miles per hour (about 150 kilometers per hour).

Figure 11:
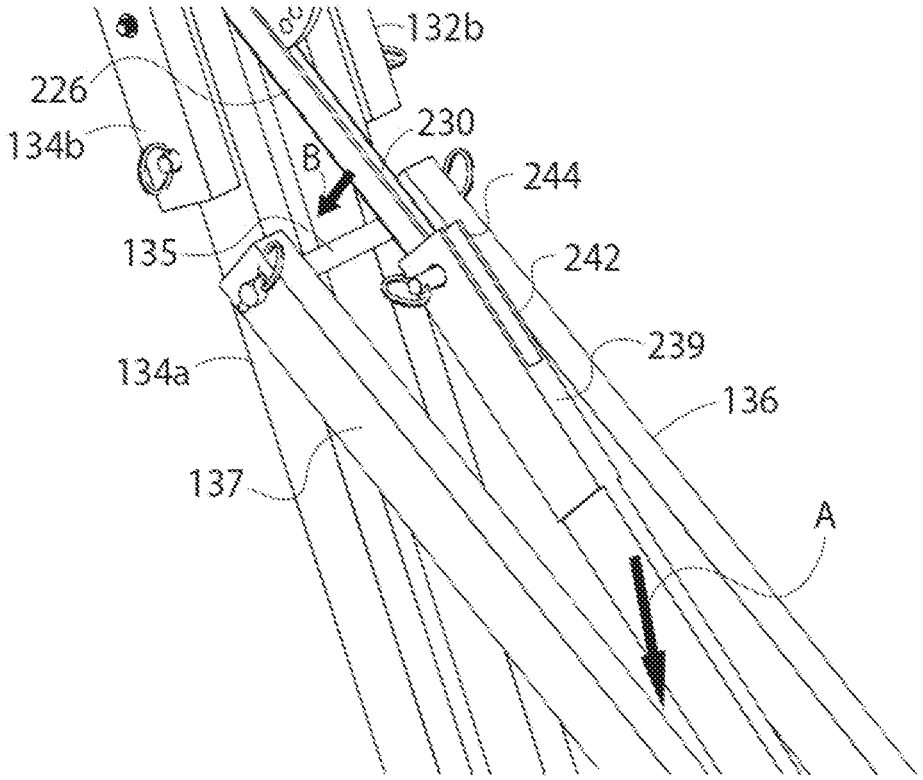
FIG. 11 is a perspective view of a lower end of the biasing member adjustment mechanism shown in FIG. 10.
Figure 11A:
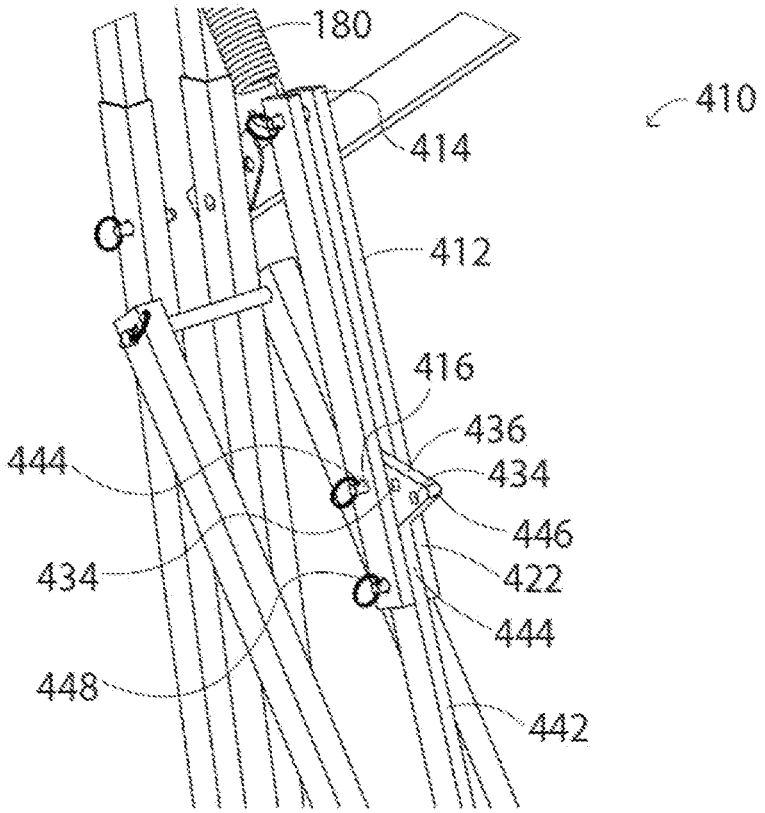
FIG. 11A is a perspective view of an alternative embodiment of a speed adjusting mechanism used with the machine of FIG. 1.
Figure 11B:
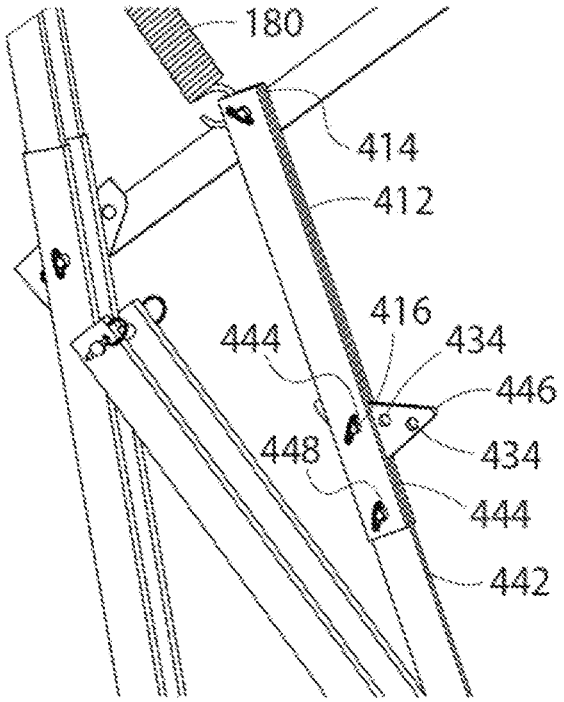
FIG. 11B is a side elevational view of the speed adjusting mechanism of FIG. 11A.

FIGS. 11A and 11B show an alternative embodiment of a speed adjustment mechanism 410 according to the present invention. A load arm 412 is a linear bar having a first end 414 connected to biasing member 180 and a second end 422 connected to a connecting arm 442 at a connection 448. Load arm 412 also includes a slot 416 extending part way up the length of load arm 412 from second end 422.

A top end 444 of connecting arm 442 includes a cam 446 having a plurality of slots 434 spaced around a top end 436 in an arc. Slot 416 in load arm 412 is located such that connecting arm 442 can be pivoted relative to load arm 412 at connection 448 such that a selected one of the slots 434 lines up with slot 416 in load arm 412 such that a pin 444 can be inserted therein to secure load arm 412 to connecting arm 442. The selection of different slots 434 changes the angle of connecting arm 442 relative to load arm 412, thereby changing the effective length between biasing member 180 and pedal assembly 239, adjusting the tension applied to biasing member and the resulting speed of throwing arm when ball 60 is launched.

Figure 11C:
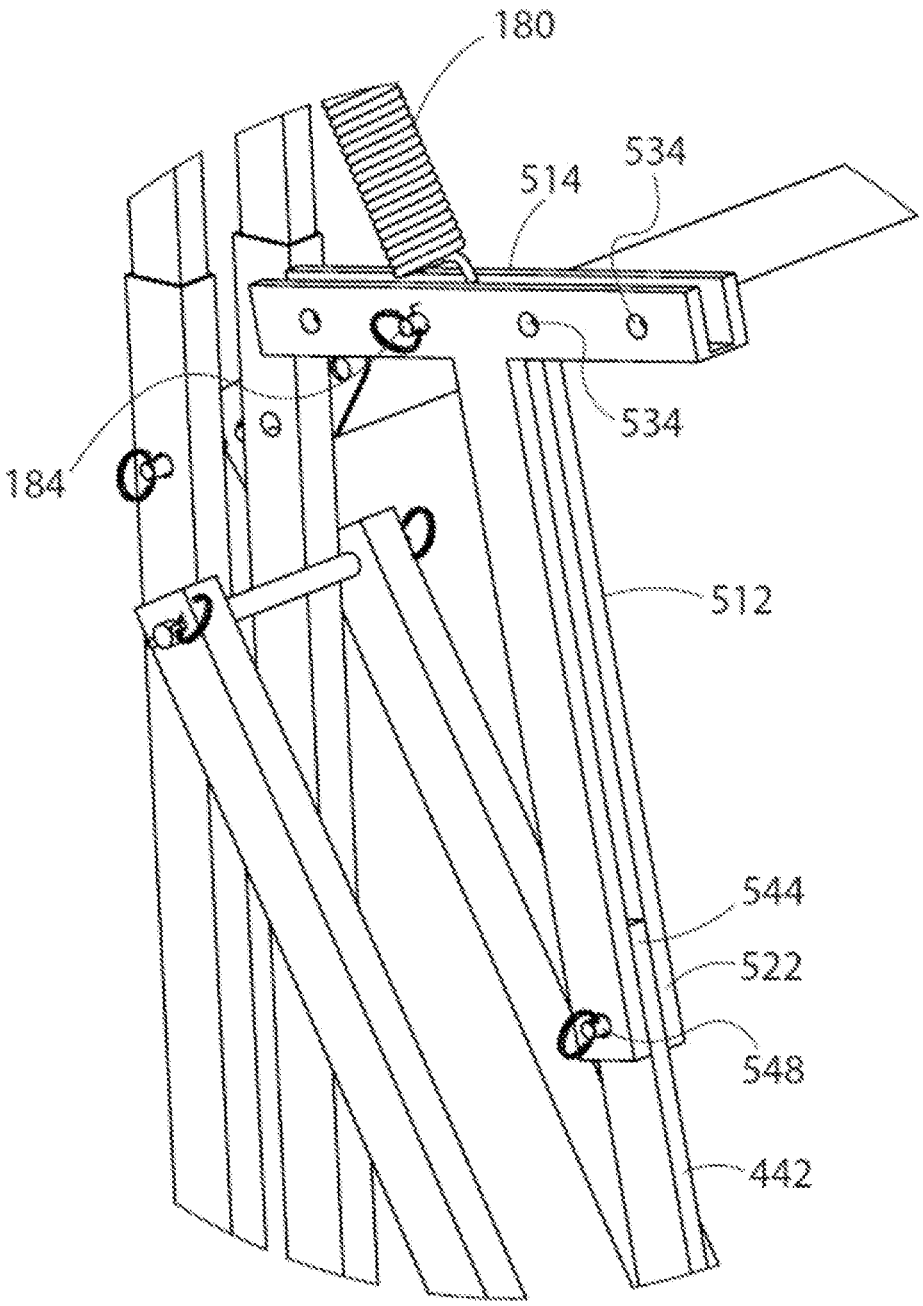
FIG. 11C is a perspective view of another alternative embodiment of a speed adjusting mechanism used with the machine of FIG. 1.

FIG. 11C shows another alternative embodiment of a speed adjustment mechanism 510 according to the present invention. A load arm 512 is a generally "T-shaped" bar having a top end 514 releasably connected to biasing member 180 and a bottom end 522 connected to connecting arm 442 at a connection 548.

Top end 514 of load arm 512 includes a plurality of slots 534 spaced throughout. Second end 184 of biasing member 180 is selectively inserted into one of the plurality of slots 534. The selection of different slots 534 changes the angle of connecting arm 442 relative to biasing member 180, thereby changing the effective length between biasing member 180 and pedal assembly 239, adjusting the tension applied to biasing member 180 and the resulting speed of throwing arm when ball 60 is launched.

In an exemplary embodiment, machine 100 can be largely constructed from steel, or some other a rigid, lightweight material, such as aluminum, to reduce weight for the ease of transport. Those skilled in the art, however, will recognize that machine 100 can be constructed from other materials, such as composites.

To set machine 100 for launching ball 60, prior to applying any tension to biasing member 60, a user selects a desired speed varying location 234 for engagement with pin 224. Additionally, the user selects a desired slot 270 into which to insert locking arm 272. The user pulls throwing arm 150 back grasping end 194 until ball end 156 is engaged by and secured to throwing arm engager 196.

The user at this time can adjust cradle 160 to impart the desired pin on ball 60 and then place ball 60 in cradle 160. The user then steps on foot pad 256 and depresses foot pad 256 toward frame 110, applying more tension to biasing member 180. After foot pad 256 is depressed below locking arm 272, the user rotates handle 260 as shown by arrow "D" in FIG. 13 such that locking arm 272 is above foot pedal 256 and releases foot pedal 256, allowing foot pedal 256 to bias upward and engage locking arm 272.

At this point, machine 100 is ready to launch ball 60. When the user is ready, the user pulls grasping end 194 of pull handle 188 toward himself, releasing toward ball end 156 of throwing arm 150 from throwing arm engager 186 and allowing biasing member 180 to contract, pivoting throwing arm 150 about pivot 152 and launching ball 60 from machine 100.

After ball 60 is launched, the user rotates handle 260 to allow foot pedal 250 to raise up, releasing tension from biasing member 180. Machine 100 is now in a condition to be re-set to launch another ball 60.

Figure 14:
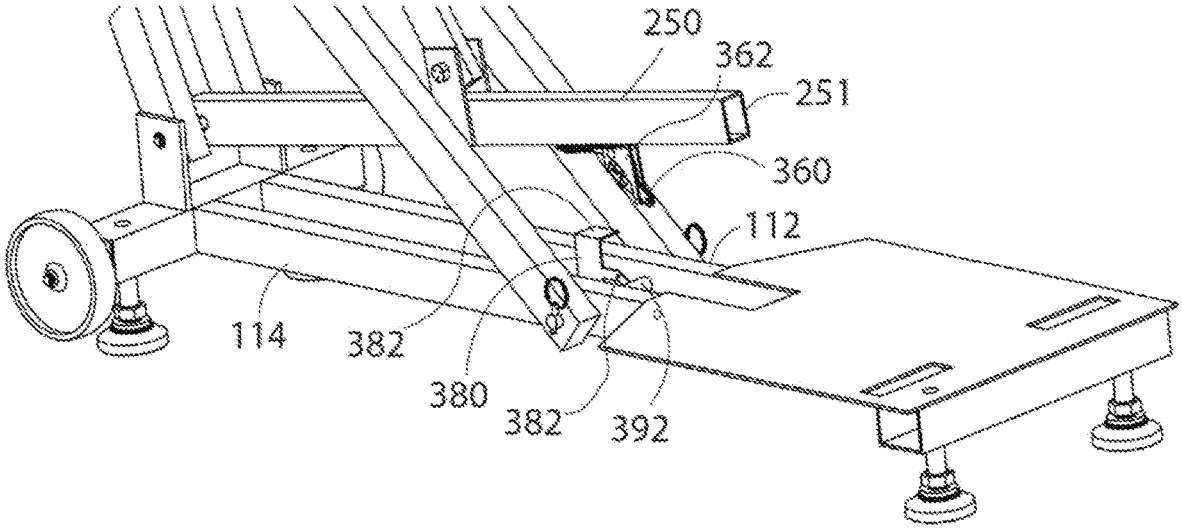
FIG. 14 is a perspective view of an alternative embodiment of a foot pedal locking mechanism used with the projectile launching machine of FIG. 1.
Figure 15:
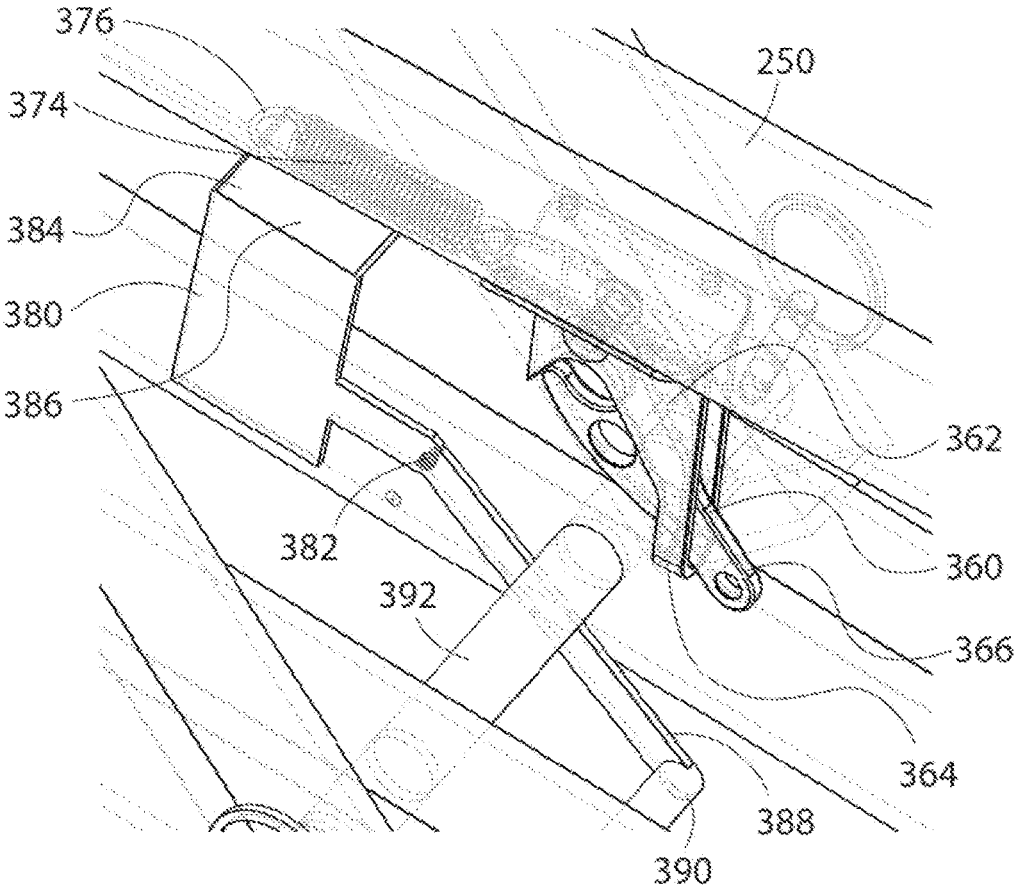
FIG. 15 is an enlarged view of the locking mechanism of FIG. 14 used with the projectile launching machine of FIG. 1.
Figure 16:
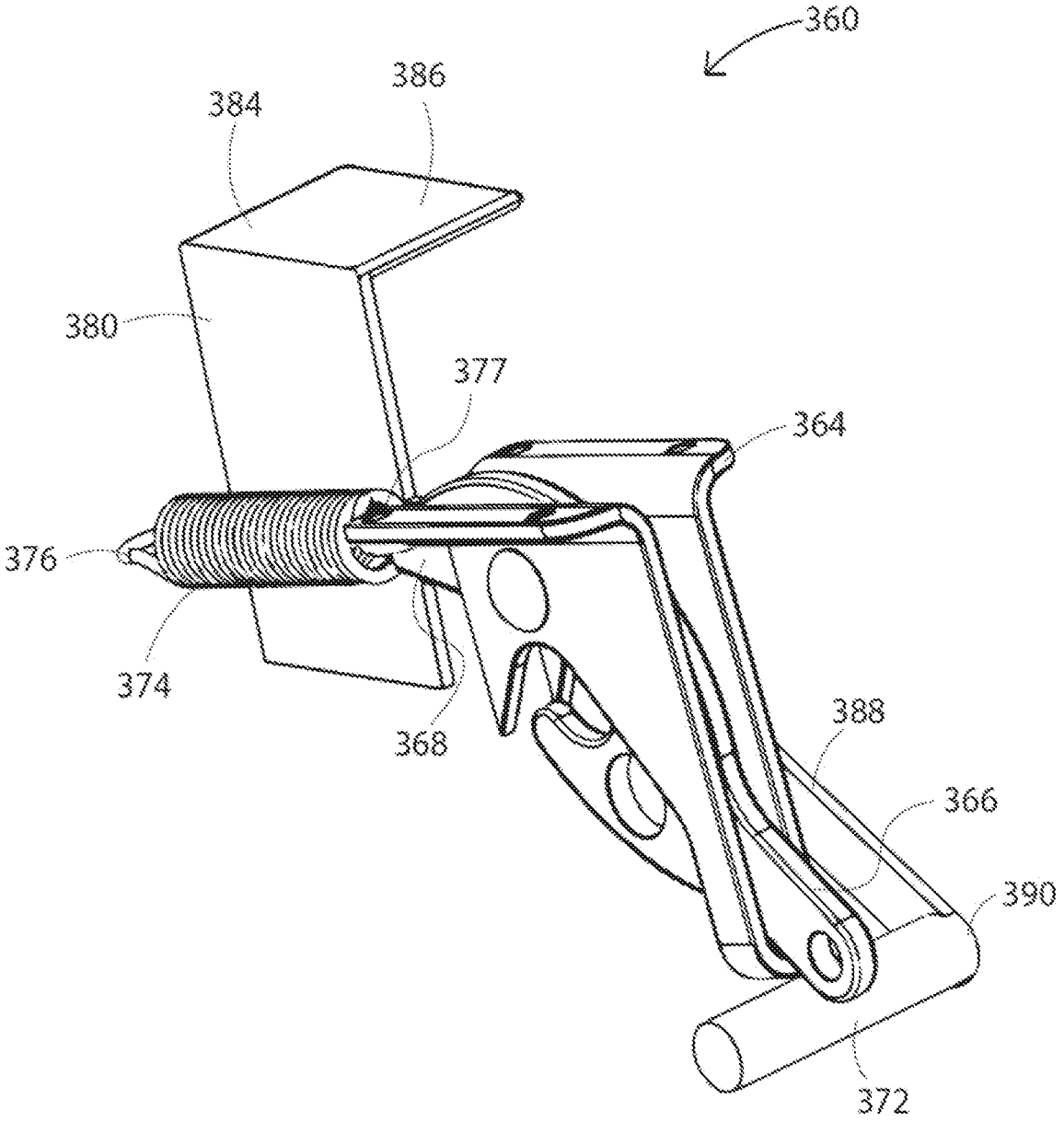
FIG. 16 is a perspective view of the locking mechanism of FIGS. 14 and 15, without the projectile launching machine.

While locking mechanism 260 is shown in FIGS. 12 and 13, an alternative embodiment of a foot pedal locking mechanism 360 is shown in FIGS. 14-16. Locking mechanism 360 includes a lock 362 that is mounted to an underside 251 of foot pedal 250. Lock 362 includes a frame 364 and a movable lock member 366 that is pivotally connected to frame 364. Movable lock member 366 includes a forward, biased end 368 and a rear lift engager 372. A biasing member 374, such as a helical spring, has a first end 376 connected to foot pedal 250 and a second end 377 connected to biased end 368 such that biasing member 374 biases rear lift engager 372 in a downward position.

A release pedal assembly 380 is pivotally mounted on frame leg 112 about pivot 382. Release pedal assembly 380 includes a forward end 384 having a generally planar release pedal 386 that extends above frame leg 112 and a rear end 388 having a lifting bar 390 that extends toward frame leg 114.

A lock bar 392 extends laterally between frame leg 112 and frame leg 114 such that, when foot pedal 250 is depressed, movable lock member 366 engages lock bar 392, releasably securing foot pedal 250 to lock bar 392. After ball 60 is launched, the user depresses release pedal 386, pivoting lifting bar 390 upward and engaging lift engager 372 to move lock member 366 and open lock 362, releasing lock member from lock bar 392, thereby allowing foot pedal to pivot upwardly and release tension from biasing member 180. Biasing member 374 pulls on biased end 368 of lock member 366 such that, when foot pedal 250 is depressed again, lock member 366 can engage lock bar 392.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A projectile launching machine comprising:

a base having a front end and a rear end;

a front leg assembly having a lower end coupled to the front end of the base and an upper end, distal from the lower end;

a throwing arm pivotally coupled to the upper end of the front leg assembly at a pivot, the throwing arm having a biased end extending from the pivot and a ball end distal from the biased end, the throwing arm movable between a locked position and a throw position;

a biasing member having a first biasing member end connected to the biased end and a second biasing member end movably coupled to the front leg assembly;

an arm release mechanism having a first end connected to the front leg assembly between the lower end and the upper end, and a second end movable between a locking position wherein the throwing arm is in the locked position and a release position wherein the throwing arm is biased by the biasing member to the throw position; and a biasing member adjustment mechanism comprising:

a load arm having a free end connected to the second biasing member end and a pivot end pivotally coupled to the front leg assembly;

a tension arm having a first tension arm end pivotally coupled to the pivot end of the load arm and a connecting arm end; and a speed adjuster connected to the tension arm and having a plurality of speed varying locations releasably connectable to the load arm.

2. The projectile launching machine according to claim 1, wherein the connecting arm end of the tension arm is pivotally connected to a foot pedal operatively connected to the tension arm between a pedal release position and a tension adding position wherein tension is added to the biasing member.

3. The projectile launching machine according to claim 2, further comprising a connecting arm having a first end of the connecting arm coupled to the connecting arm end of the tension arm and a second end of the connecting arm coupled to the foot pedal.

4. The projectile launching mechanism according to claim 2, wherein the foot pedal comprises a coupled end pivotally coupled to one of the frame and the front leg assembly.

5. The projectile launching machine according to claim 4, wherein the foot pedal further comprises a foot pad distal from the coupled end and a central portion coupled to the second end of the connecting arm.

6. The projectile launching machine according to claim 2, further comprising a locking mechanism adapted to releasably lock the foot pedal in the tension adding position.

7. The projectile launching mechanism according to claim 6, wherein the locking mechanism comprises a handle rotatable between a pedal locking position and a pedal release position.

8. The projectile launching machine according to claim 7, wherein the handle comprises a vertically adjustable locking arm.

9. The projectile launching mechanism according to claim 6, wherein the locking mechanism comprises a lock rotatably connected to the base.

10. The projectile launching machine according to claim 1, wherein the speed varying locations are aligned to form an arc.

11. The projectile launching machine according to claim 1, wherein the second end of the arm release mechanism comprises a pull handle pivotally coupled to a holding arm, wherein the pull handle is biased from a throwing arm release position to a throwing arm locking position.

12. The projectile launching machine according to claim 1, further comprising a cradle at the ball end of the throwing arm, wherein the cradle is adapted to receive and retain a projectile.

13. The projectile launching machine according to claim 12, wherein the cradle is adjustably mounted on the throwing arm.

14. The projectile launching machine according to claim 12, wherein the cradle comprises a first finger mounted on a first side of the throwing arm and a second finger mounted on an opposing side of the throwing arm.

15. The projectile launching machine according to claim 14, wherein each of the first finger and the second finger are independently adjustable relative to the throwing arm.

16. A projectile launching machine comprising:

a base having a front end and a rear end;

a front leg assembly having a lower portion pivotally coupled to the front end of the base and an upper portion, distal from the lower portion, the upper portion being pivotally attached to the lower portion;

a throwing arm pivotally directly coupled to the upper portion of the front leg assembly at a pivot, the throwing arm having a biased end extending from the pivot and a ball end distal from the biased end, the throwing arm movable between a locked position and a throw position;

a holding arm having a having a first holding arm rod and a second holding arm rod, with each of the first and second holding arm rods having a first end directly connected to the front leg assembly between the lower portion and the upper portion, and a second end;

a handle bar extending from the second end of each holding arm rod;

a biasing member having a first biasing member end connected to the biased end of the throwing arm and a second biasing member end movably coupled to the front leg assembly, wherein the biasing member extends between the first holding arm rod and the second holding arm rod;

and an arm release mechanism coupled to the second end of the holding arm rod and movable between a locking position wherein the throwing arm engages the arm release mechanism such that the throwing arm is in the locked position and a release position wherein the throwing arm is released from the arm release mechanism such that the biasing member pivots the throwing arm to the throw position.

17. A projectile launching machine comprising:

a base having a front end and a rear end;

a front leg assembly having a lower portion pivotally coupled to the front end of the base and an upper portion, distal from the lower portion, the upper portion being pivotally attached to the lower portion;

a brace having a first end removably attached to the lower portion and a second end removably attached to the base;

a throwing arm pivotally directly coupled to the upper portion of the front leg assembly at a pivot, the throwing arm having a biased end extending from the pivot and a ball end distal from the biased end, the throwing arm movable between a locked position and a throw position;

a biasing member having a first biasing member end connected to the biased end of the throwing arm and a second biasing member end movably coupled to the front leg assembly;

and an arm release mechanism attached to the front leg assembly and movable between a locking position wherein the throwing arm engages the arm release mechanism such that the throwing arm is in the locked position and a release position wherein the throwing arm is released from the arm release mechanism such that the biasing member pivots the throwing arm to the throw position.

* * * * *